US010711209B2

(12) United States Patent
Tian et al.

(10) Patent No.: US 10,711,209 B2
(45) Date of Patent: Jul. 14, 2020

(54) GASIFICATION CO-GENERATION PROCESS OF COAL POWDER IN A Y-TYPE ENTRAINED FLOW BED

(71) Applicant: China University of Petroleum (East China), Qingdao (CN)

(72) Inventors: Yuanyu Tian, Qingdao (CN); Yingyun Qiao, Qingdao (CN); Kechang Xie, Qingdao (CN); Jinhong Zhang, Qingdao (CN); Peijie Zong, Qingdao (CN); Yuan Jiang, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 16/671,461

(22) Filed: Nov. 1, 2019

(65) Prior Publication Data

US 2020/0140769 A1 May 7, 2020

(30) Foreign Application Priority Data

Nov. 2, 2018 (CN) ..... 2018 1 1300525

(51) Int. Cl.

*C10J 3/48* (2006.01)
*C10J 3/56* (2006.01)
*C10J 3/52* (2006.01)

(52) U.S. Cl.

CPC ..... *C10J 3/485* (2013.01); *C10J 3/526* (2013.01); *C10J 3/56* (2013.01); *C10J 2200/09* (2013.01); *C10J 2200/152* (2013.01); *C10J 2300/093* (2013.01); *C10J 2300/0956* (2013.01); *C10J 2300/0959* (2013.01); *C10J 2300/0976* (2013.01); *C10J 2300/0996* (2013.01); *C10J 2300/1606* (2013.01); *C10J 2300/1631* (2013.01); *C10J 2300/1884* (2013.01)

(58) Field of Classification Search

CPC ..... C10J 3/485; C10J 3/526
See application file for complete search history.

(56) References Cited

U.S. PATENT DOCUMENTS

| | | | | |
|---|---|---|---|---|
| 4,391,612 A * | 7/1983 | Chang | C10J 3/54 | 48/202 |
| 7,883,556 B1 * | 2/2011 | Wintrell | C10J 3/08 | 48/197 FM |
| 2003/0089038 A1 * | 5/2003 | Weaver | C10J 3/466 | 48/210 |
| 2009/0188347 A1 * | 7/2009 | Taber | B82Y 30/00 | 75/301 |
| 2010/0018117 A1 * | 1/2010 | Zhou | C10J 3/485 | 48/77 |
| 2014/0202364 A1 * | 7/2014 | Nakayama | F23G 5/0276 | 110/346 |

* cited by examiner

*Primary Examiner* — Matthew J Merkling
(74) *Attorney, Agent, or Firm* — Volpe and Koenig, P.C.

(57) ABSTRACT

A gasification co-generation process of coal powder in a Y-type entrained flow bed, comprising: spraying coal water slurry or coal powder, gasification agent and water vapor into a gasification furnace through a top nozzle and a plurality of side nozzles for performing combustion and gasification with a residence time of 10 s or more; chilling the resulting slag with water, and subjecting the chilled slag to a dry method slagging to obtain gasification slag used as cement clinker; discharging the produced crude syngas carrying fine ash from the Y-type entrained flow bed to perform ash-slag separation.

10 Claims, 1 Drawing Sheet

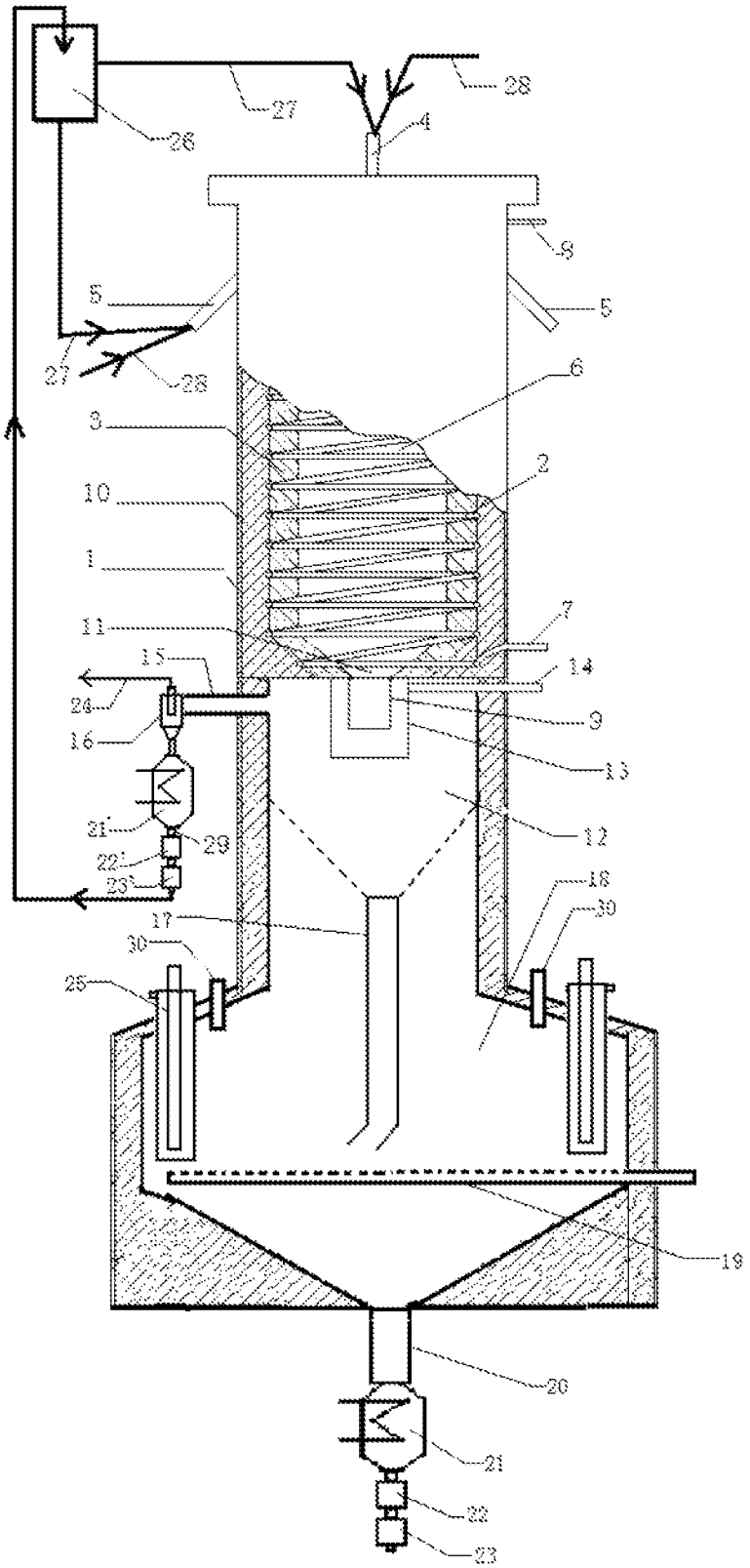
28
27
26
4
8
5
5
27
28
6
3
2
10
1
7
11
15
14
24
9
16
13
21'
29
12
22'
23'
18
30
17
30
25
19
20
21
22
23

GASIFICATION CO-GENERATION PROCESS OF COAL POWDER IN A Y-TYPE ENTRAINED FLOW BED

CROSS REFERENCE TO RELATED APPLICATIONS

The application claims priority to Chinese Application No. 201811300525.1, filed on Nov. 2, 2018, entitled "Y-type flow bed coal coke powder clean and highly efficient combining production process", which is herein specifically and entirely incorporated by reference.

FIELD

The present disclosure relates to the technical field of coal chemistry industry, and particularly relates to a gasification co-generation process of coal powder in a Y-type entrained flow gasification.

BACKGROUND

Coal gasification is a leading and key technology for the clean and efficient utilization of coal. Entrained flow gasification is a new type of coal parallel flow gasification technology developed in recent decades. The gasification agent and coal powder or coal slurry enter a gasification furnace through a plurality of nozzles, the pyrolysis, combustion and gasification reaction of coal are carried out almost simultaneously. The high temperature in the gasification furnace ensures complete gasification of the coal, and the minerals in the coal become slag and leave the gasification furnace. Compared with the traditional gasification technology, the pressurized gasification process with an entrained flow gasification has the advantages such as high temperature, large processing capacity, high content of effective constituents in the fuel gas and high gasification efficiency. It presents the future development direction of the coal gasification technology, it is also one of the landmark coal chemical industry technologies which have been widely used in China and foreign countries, and are representatives of the advanced technologies in the world.

However, the coal chemical industry has been harshly criticized for its high water consumption and energy consumption, wherein the primary cause is the high water consumption and energy consumption of coal gasification technology. While in the coal gasification process, the chemical water consumption for the coal gasification reaction process is only ⅕ of the physical water consumption of the technological processes such as chilling and washing. Therefore, the pivotal issue of saving water in the gasification of the entrained flow gasification is to avoid and reduce the physical water consumption. However, the existing entrained flow gasification process, both the dry powder gasification and the coal water slurry gasification contain the step of discharging wet slag and the step of wetting and washing in the carbon wash tower, on the one hand, the steps consume a large amount of water, and result in a large amount of black water and salinity-containing wastewater which are difficult to treat, and the crystallization waste salts are hazardous chemical which can hardly be processed; on the other hand, the high temperature residual heat in the reaction process is not effectively utilized, thus the energy consumption is high; moreover, the difficulty in dehydration of wet slag and ash cake having a high content of carbon hampers the comprehensive utilization, and the dumping and landfill treatment is prone to cause secondary pollution.

The aforementioned problems have become the biggest bottleneck to enhance quality and improve efficiency and obtain the clean, efficient and low carbon development for the coal chemical industry in the world.

At present, the co-generation technology of combusting coal powder and cogenerating cement clinker by controlling the ash composition is a hot research topic at home and abroad. However, due to the fact that the combustion temperature is at the critical reaction temperature of cement and the residence time is short during the gasification process, it causes that the solid-solid reaction strength and time period are insufficient or the ash content is difficult to control. Only a small number of processes have been subjected to pilot scale test or demonstration at present. In addition, the produced cement clinker has not achieved the desired effect, thus the poly-generation technology is still in a process of research and exploration.

In the existing gasification co-generation technology, the reducing atmosphere of the gasification furnace and the oxidizing atmosphere of the combustion furnace are different, which increase the difficulty to co-produce cement clinker from the coal powder gasification furnace and slag; in addition, the existing gasification furnace has a short residence time of the solid materials, and the ash and slag are in a blended status, which directly affect the properties of the co-produced cement; moreover, a process of discharging slag with a wet method may be extremely prone to cause the hydration reaction, thereby form the agglomeration and blockage.

Therefore, the research on the co-production of cement clinker from the coal powder and the gasification slag may solve the problem concerning how to perform large-scale resource utilization with high added value on the solid waste generated by the coal gasification process. Therefore, the pivot issue and key point for the future development of the entrained flow bed for performing the clean and efficient coal gasification co-generation technology reside in how to reduce the physical water consumption, sufficiently recover the thermal energy, and perform large-scale resource utilization with high added value on the gasification furnace slag.

SUMMARY

To solve the technical problems of the above-mentioned major defects and deficiencies of the existing co-production cement technology with a entrained flow gasification and gasification furnace, the present disclosure provides a gasification co-generation process of coal powder in a Y-type entrained flow bed.

In an aspect, the present disclosure provides a gasification co-generation process of coal powder in a Y-type entrained flow bed, which comprises the following steps:

(1) mixing coal with lime powder to obtain coal powder, or mixing the coal, lime powder and water to obtain coal water slurry; in the coal water slurry or coal powder, the weight ratio of calcium to aluminum is 2-4:1, the weight ratio of calcium to silicon is 1-4:1, and the weight ratio of calcium to iron is 1-3:1;

(2) introducing the coal water slurry or coal powder, gasification agent and water vapor into a gasification furnace of a Y-type entrained flow bed, and performing combustion and gasification at a temperature range of 1,300-2,000° C., so as to produce a crude syngas and slag at a temperature range of 1,300-2,000° C.;

wherein, the coal water slurry or coal powder, gasification agent and water vapor are sprayed into the gasification furnace through a top nozzle and a plurality of side nozzles of the gasification furnace, and collide, ignite and turbulently mix with each other at the combustion chamber center of the gasification furnace, to form a rotational strike and high temperature reaction zone; the residence time of a residual ash generated by the combustion and gasification in the rotational strike and high temperature reaction zone is 10 s or more;

the residual ash is thrown toward the furnace wall of the gasification furnace and swirled downward and solidified on the furnace wall of the gasification furnace to form a slag layer;

(3) introducing the crude syngas and slag into a chilling chamber to carry out chilling with water, wherein the slag is cooled and solidified into a solid slag with a temperature of 500-950° C.; the solid slag passes through a solid discharge pipe with a perforated conical head and flows into a fluidized bed heat extractor, and then its temperature is reduced to 120-500° C. under the action of a fluidized vapor and an atomized water mist or a heat extraction sleeve to obtain a gasification slag, in the meanwhile, the fluidized vapor carries a fine ash having a high content of residual carbon and flows upward to pass through the perforated conical head, so as to further fluidize and sort the fine ash in the solid slag, then obtained fluidized vapor containing fine ash mixes with the crude syngas; the gasification slag is discharged from a fluid bed heat extractor, and is further cooled to a temperature less than 80° C. and subjects to a dry method slagging to produce a cement clinker;

the crude syngas is cooled by the chilling with water to a temperature range of 500-950° C., and carries the fine ash and is discharged from the chilling chamber to separate the fine ash from the gasification slag;

(4) discharging the crude syngas carrying fine ash from the chilling chamber, and further performing a gas-solid separation by means of a gas-ash separator, a separated and purified syngas enter into a convective waste pot for heat recovery and is then ready for use; a separated fine ash passes through an ash exhaust port and is discharged into a moving bed heat exchanger, and is cooled to a temperature less than 500° C. and discharged and then returned to step (1) and mixed into the coal.

By means of the above-mentioned technical solution, the present disclosure provides a process to allow the coal powder or coal water slurry to successively pass through a gasification furnace, a chilling chamber and a fluidized bed heat extractor in a Y-type entrained flow bed, and subject to combustion and gasification, slag solidification, ash-slag separation, and can be performed with a dry method slagging, such that the coal is gasified to produce a syngas and cogenerate a cement clinker, for example, high-grade cement with an index 625 in accordance with the national standard GB12958-1999 ("Composite Portland Cement") of the PRC.

The combustion and gasification process is carried out in a gasification furnace to obtain crude syngas and slag. The top nozzle and a plurality of side nozzles spray the raw materials (coal water slurry or coal powder, gasification agent and water vapor) into the gasification furnace to form a rotational strike and high temperature reaction zone. The residual ash and slag generated by the combustion and gasification stays in the rotational strike and high temperature reaction zone for 10 s or more, which may be extended 10 times or more than the residence time in the prior art, such that the conversion rate of carbon is higher, and it is beneficial for the resulting slag in combination with the subsequent dry method slagging for further producing the qualified cement clinker. In addition, the residual ash and slag can be solidified on the furnace wall of the gasification furnace to form a slag layer, which may facilitate the furnace wall of the gasification furnace to resist corrosion of the liquid slag during the combustion and gasification process, thus the facility has a long service life.

The slag is subjected to solidification by the atomized water in the chilling chamber, and the successive heat exchanging and cooling in the fluidized bed heat extractor, finally the gasified slag is obtained by dry slag discharging, thereby perform gasification of coal to cogenerate the cement clinker. At the same time, the crude syngas is also cooled down and carries the produced fine ash and then be discharged from the chilling chamber, which can realize the ash-slag separation, reduce an influence of the fine ash on the quality of gasification slag, improve the quality of the gasification slag as the cement clinker, and eliminate the black water and salinity-containing wastewater, as well as the problems concerning discharge and post-treatment of the waste slag.

The crude syngas containing fine ash is discharged from the chilling chamber, and is further subjected to the gas-ash separation, the produced gas is further purified, and the heat is recovered by a convective waste pot in order to improve the energy utilization; the obtained fine ash having a high content of residual carbon is cooled and returned to mix with the raw material coal for the cycle use, thereby improve utilization of carbon.

The process provided by the present disclosure may prolong the residence time of the produced residual ash in the rotational strike and high temperature reaction zone during the combustion and gasification process, it may facilitate the slag formed in the coal gasification process to be produced into the cement clinker, and a slag layer may be formed on the furnace wall of the gasification furnace, thereby extending service life of the facility. The slag generated in the combustion and gasification process may finally subject to the dry method slagging to obtain the gasification slag, and generate a by-product of cement clinker with high added value. Moreover, the process provided by the present disclosure can eliminate the defects of generating salinity-containing wastewater, black water and waste slag in the prior technology and reduce the secondary pollution. The crude syngas is used for carrying fine ash, and can be further separated and subject to heat recovery and return the fine ash for reuse, which can recover energy and improve carbon utilization, and can meet the requirements of the industrial department for the efficient and large-scale synthetic gasification furnace.

BRIEF DESCRIPTION OF THE DRAWINGS

The accompanying drawings are provided here to facilitate further understanding on the present disclosure, and constitute a part of this document. They are used in conjunction with the following embodiments to explain the present disclosure, but shall not be comprehended as constituting any limitation to the present disclosure.

FIG. 1 is a schematic diagram of gasification process of coal powder in a Y-type entrained flow bed in the present disclosure.

Description of the reference signs 1. housing
2. cooling sleeve
3. refractory layer
4. top nozzle
5. side nozzle
6. gasification furnace
7. coolant inlet
8. coolant outlet
9. gasification product exhaust port
10. insulation material layer
11. segmented conical head.
12. chilling chamber
13. swirl cooling sleeve
14. chilling water nozzle
15. crude syngas outlet
16. gas-ash separator
17. solid tremie pipe
18. fluidized bed heat extractor
19. distributor
20. slag exhaust port
21. moving bed heat exchanger
22. first-level lock bucket
23. second-level lock bucket
21'. moving bed heat exchanger
22'. first-level lock bucket
23'. second-level lock bucket
24. syngas outlet
25. heat extraction sleeve
26. pulverized coal silo
27. pulverized coal line
28. gasification agent and water vapor line
29. ash exhaust port
30. cooled water atomization heat extraction nozzle

DETAILED DESCRIPTION

The terminals and any value of the ranges disclosed herein are not limited to the precise ranges or values, such ranges or values shall be comprehended as comprising the values adjacent to the ranges or values. As for numerical ranges, the endpoint values of the various ranges, the endpoint values and the individual point value of the various ranges, and the individual point values may be combined with one another to yield one or more new numerical ranges, which should be considered as specifically disclosed herein.

As illustrated in the FIGURE, the present disclosure provides a gasification co-generation process for coal powder in a Y-type entrained flow bed which comprises the following steps:

(1) mixing coal with lime powder to obtain coal powder, or mixing the coal, lime powder and water to obtain coal water slurry; in the coal water slurry or coal powder, the weight ratio of calcium to aluminum is 2-4:1, the weight ratio of calcium to silicon is 1-4:1, and the weight ratio of calcium to iron is 1-3:1;

(2) introducing the coal water slurry or coal powder, gasification agent, and water vapor into a gasification furnace of a Y-type entrained flow bed, and performing combustion and gasification at a temperature range of 1,300-2,000° C., so as to produce a crude syngas and slag at a temperature range of 1,300-2,000° C.;

wherein, the coal water slurry or coal powder, gasification agent and water vapor are sprayed into the gasification furnace through a top nozzle and a plurality of side nozzles of the gasification furnace, and collide, ignite and turbulently mix with each other at the combustion chamber center of the gasification furnace, to form a rotational strike and high temperature reaction zone; the residence time of a residual ash generated by the combustion and gasification in the rotational strike and high temperature reaction zone is 10 s or more;

the residual ash is thrown toward the furnace wall of the gasification furnace and swirled downward, and solidified on the furnace wall of the gasification furnace to form a slag layer;

(3) introducing the crude syngas and slag into a chilling chamber to carry out chilling with water, wherein the slag is cooled and solidified into a solid slag with a temperature of 500-950° C.; the solid slag passes through a solid discharge pipe with a perforated conical head and flows into a fluidized bed heat extractor, and then its temperature is reduced to 120-500° C. under the influence of a fluidized vapor and an atomized water mist or a heat extraction sleeve to obtain a gasification slag, in the meanwhile, the fluidized vapor carries a fine ash having a high content of residual carbon and flows upward to passes through the perforated conical head, so as to further fluidize and sort the fine ash in the solid slag, then obtained fluidized vapor containing fine ash mixes with the crude syngas; the gasification slag is discharged from a fluid bed heat extractor, and is further cooled to a temperature less than 80° C. and subjects to a dry method slagging to produce a cement clinker;

the crude syngas is cooled by the chilling with water to a temperature range of 500-950° C., and carries the fine ash and is discharged from the chilling chamber to separate the fine ash from the gasification slag;

(4) discharging the crude syngas carrying fine ash from the chilling chamber, and further performing a gas-solid separation by means of a gas-ash separator, a separated and purified syngas enter into a convective waste pot for heat recovery and is then ready for use; a separated fine ash passes through an ash exhaust port and is discharged into a moving bed heat exchanger, and is cooled to a temperature less than 500° C. and discharged and then returned to step (1) and mixed into the coal.

In the present disclosure, the content of residual carbon of the fine ash is 12-30 wt %, and the average particle diameter of the fine ash is 5-15 μm.

In an embodiment provided by the present disclosure, preferably, the weight ratio of raw materials ejected from the top nozzle and raw materials ejected from the side nozzles is 1-4:1. The raw materials include the coal water slurry or coal powder, gasification agent, and water vapor.

In an embodiment provided by the present disclosure, the gasification agent is preferably oxygen, air, or oxygen-enriched air containing not less than 21% by volume of oxygen.

In an embodiment provided by the present disclosure, preferably, the weight ratio of the coal powder, the gasification agent and the water vapor is 1,000:(120-360):(100-200), or the weight ratio of the coal water slurry and the gasification agent is 1,000:(120-360). When the coal water slurry is used, it is no necessary to add the water vapor further.

In an embodiment provided by the present disclosure, preferably, the Y-type entrained flow bed comprises a gasification furnace and a chilling chamber separated by a perforated segmented conical head, and a fluidized bed heat extractor underneath the chilling chamber.

In an embodiment provided by the present disclosure, preferably, the top center of the gasification furnace is provided with a top nozzle, and the upper portion of the gasification furnace is provided with 3 or more side nozzles which are disposed radially inclined along the circumferential direction.

According to an embodiment provided by the present disclosure, the segmented conical head is preferably disposed at the bottom of the gasification furnace, the segmented conical head has a central opening and a gasification product exhaust port underneath the opening, wherein the gasification product exhaust port is communicated with the chilling chamber.

In an embodiment provided by the present disclosure, preferably, the upper portion of the chilling chamber is provided with a crude syngas outlet connected to the gas-ash separator.

In an embodiment provided by the present disclosure, preferably, a plurality of independent cooled water atomization heat extraction nozzles and a heat extraction sleeve are disposed on an upper portion of the fluidized bed heat extractor, and a slag exhaust port is disposed at a bottom of the fluidized bed heat extractor.

In an embodiment provided by the present disclosure, preferably, wherein the arrangement condition of the radially inclined side nozzle comprises: an included angle between an axial direction of the side nozzles and an axial direction of the gasification furnace is within a range of 75°-90°; the central axis of the side nozzles is not coplanar with the central axis of the gasification furnace, a central axis of the side nozzles is offset from a cross section passing through an intersection point between the central axis of the side nozzles and the circumference of said gasification furnace by an angle ranging from 5°-75°. Wherein, the side nozzles may be inclined and extended upward from the side wall of the gasification furnace, or may be inclined and stretched downward from the side wall of the gasification furnace. Wherein, "a cross section passing through an intersection point between the central axis of the side nozzles and the circumference of said gasification furnace" refers to that the section is the longitudinal section of the gasification furnace, it passes through the central axis of the gasification furnace, and the intersection point of the central axis of the side nozzle and the circumference of the gasification furnace. Wherein, the central axis of the side nozzle may be disposed at the horizontal direction, or may be offset from the cross section leftward or rightward.

In an embodiment provided by the present disclosure, the gasification furnace preferably has a height/diameter ratio of 2-5:1.

In one embodiment provided by the present disclosure, preferably, the distance between the spout of the side nozzle and the top of said gasification furnace is within a range of 500-2,500 mm.

In an embodiment provided by the present disclosure, preferably, the housing of the heating furnace is provided with an insulation material layer, a cooling sleeve and a refractory layer sequentially from the outside to the inside.

In an embodiment provided by the present disclosure, preferably, a coolant inlet communicating with the cooling sleeve is disposed at the bottom of the gasification furnace, and a coolant outlet communicating with the cooling sleeve is disposed at the top of the gasification furnace.

In an embodiment provided by the present disclosure, preferably, the refractory layer of the gasification furnace is formed by casting a silicon carbide or magnesium aluminum spinel material.

In an embodiment provided by the present disclosure, the cooling sleeve of the gasification furnace is preferably a cooling jacket, a cooling ring tube or a cooling pipe.

In an embodiment provided by the present disclosure, the chilling chamber preferably has a height/diameter ratio of 2-8:1.

In an embodiment provided by the present disclosure, preferably, the chilling chamber is formed by casting a heat-insulating and wear-resistant material.

In an embodiment provided by the present disclosure, preferably, the distance between the crude syngas outlet in the chilling chamber and the top of the chilling chamber is within a range of 100-1,000 mm.

In an embodiment provided by the present disclosure, preferably, the perforated conical head has an opening ratio of 3%-25%.

In an embodiment provided by the present disclosure, the lower portion of the fluidized bed heat extractor is preferably provided with a distributor for water vapor or an inert gas.

In an embodiment provided by the present disclosure, preferably, the distance between the solid tremie pipe and the distributor is within a range of 100-500 mm.

In an embodiment provided by the present disclosure, preferably in the heat extraction sleeve, the inlet pipe is connected to an inlet pipe through an inlet valve, and the outlet pipe is communicated with a steam pocket through an outlet valve.

In an embodiment provided by the present disclosure, preferably, a moving bed heat exchanger and the two-level lock bucket material discharger are sequentially provided at an outlet of the fluidized bed heat extractor and an outlet of the gas-ash separator, respectively. The two-level lock bucket material discharger includes a first-level lock bucket and a second-level lock bucket.

The present disclosure provides a coal powder gasification apparatus as shown in the accompanying FIGURE:

the device comprises a Y-type entrained flow bed, a coal powder silo 26, a syngas purification device and a slagging device;

wherein, the Y-type entrained flow bed comprises a gasification furnace 6 and a chilling chamber 12 separated by a perforated segmented conical head 11; and a fluidized bed heat extractor 18 underneath the chilling chamber 12; wherein the gasification furnace 6 and the chilling chamber 12 are vertically disposed and internally communicated with each other, and the gasification furnace 6 is disposed above the chilling chamber 12. The fluidized bed heat extractor 18 is horizontally arranged, and its inside is communicated with the gasification furnace 6 and the chilling chamber 12.

The top center of the gasification furnace 6 is provided with a top nozzle 4, and a plurality of side nozzles 5 are disposed at the upper portion of the gasification furnace 6 along a circumferential direction; the upper portion refers to a portion of the gasification furnace 6 in the vertical direction from a half height to the top. The side nozzles 5 are arranged inclined relative to the radial direction, the included angle between an axial direction of the side nozzle 5 and an axial direction of the gasification furnace 6 is within a range of 75°-90°; the central axis of the side nozzle 5 is not coplanar with the central axis of the gasification furnace 6, the central axis of the side nozzle 5 has a deviation angle 5°-75° relative to a section passing through a crosspoint between a center axis of the side nozzle 5 and a circumference of the gasification furnace 6. The distance between a spout of the side nozzle 5 and the top of the gasification furnace 6 ranges from 500 mm to 2,500 mm. The housing 1 of the gasification furnace 6 is sequentially provided with an insulation material layer 10, a cooling sleeve 2 and a refractory layer 3 from the outside to the inside; a coolant inlet 7 communicating with the cooling sleeve 2 is disposed at the bottom of the gasification furnace 6, and a coolant outlet 8 communicating with the cooling sleeve 2 is disposed at the top of the gasification furnace 6; the refractory layer of the gasification furnace 6 is made of silicon carbide or magnesium aluminum spinel material and is formed by casting. The gasification furnace 6 has a height/diameter ratio of 2-5:1.

The segmented conical head 11 is disposed at the bottom of the gasification furnace 6, the segmented conical head 11 has a central opening, and a gasification product exhaust port 9 communicating with the chilling chamber 12 is disposed underneath the opening; a swirl cooling sleeve 13 is arranged around the gasification product exhaust port 9.

The chilling chamber 12 has a height/diameter ratio of 2-8:1, and the chilling chamber 12 is made of a heat-insulating and wear-resistant material and is formed by casting. The upper part of the chilling chamber 12 is provided with a crude syngas outlet 15 connected to a gas-ash separator 16. The upper part of the chilling chamber 12 is further disposed with a chilling water nozzle 14 near the outer side of a swirl cooling sleeve 13; the lower part of the chilling chamber 12 is provided with a perforated conical sealing head (as shown by the dotted line in the FIGURE), and a solid tremie pipe 17 communicating with the fluidized bed heat extractor 18 is disposed underneath the central opening of the conical head, the perforated conical head may be connected with the solid tremie pipe 17 (i.e., a solid tremie pipe 17 provided with a perforated conical head). The distance between the crude syngas outlet and the top of the chilling chamber is within a range of 100-1,000 mm. The perforated conical head has an opening ratio within a range of 3%-25%.

The upper part of the fluidized bed heat extractor 18 is provided with a plurality of cooled water atomization heat extraction nozzles 30 and a plurality of heat extraction sleeves 25 which are independent respectively, and the bottom of the fluidized bed heat extractor 18 is provided with a slag exhaust port 20; the lower part of the fluidized bed heat extractor 18 is disposed with a distributor 19 for water vapor or inert gas. The distance between the solid tremie pipe and the distributor is 100-500 mm; in the heat extraction sleeve 25, an inlet pipe is communicated with an inlet pipe of the heat extraction sleeve 25 through the inlet valve, and an outlet pipe of the heat extraction sleeve 25 is connected to a steam pocket via an outlet valve.

The slag exhaust port 20 is connected with the moving bed heat exchanger 21, and the sequentially connected first-level lock bucket 22 and the second-level lock bucket 23 are disposed underneath the moving bed heat exchanger 21.

The gas-ash separator 16 is provided with a syngas outlet 24, and a moving bed heat exchanger 21' is disposed at a solid exhaust port of the gas-ash separator 16, and an ash exhaust port 29 of the moving bed heat exchanger 21' is sequentially connected to the first-level lock bucket 22' and the second-level lock bucket 23', the second-level lock bucket 23' is connected with a coal powder silo 26.

The coal powder silo 26 is also connected to the top nozzle 4 and the side nozzles 5 via a coal powder line 27.

The apparatus is also provided with a gasifying agent and a water vapor line 28, which are communicated with the top nozzle 4 and the side nozzles 5.

With reference to the accompanying drawing, the method provided by the present invention is implemented as follows:

Based on the composition of the coal obtained by analysis, the coal and the lime powder are mixed to obtain coal powder, or the coal, the lime powder and water are mixed to obtain the coal water slurry; in the coal water slurry or the coal powder, the ratio of calcium to aluminum is 2-4:1, the ratio of calcium to silicon is 1-4:1, and the ratio of calcium to iron is 1-3:1 (each is the weight ratio calculated based on the elements); the solid content of coal water slurry is 55-75% by weight;

the coal water slurry or coal powder in the coal powder silo 26 is introduced into the top nozzle 4 and the side nozzles 5 via the coal powder line 27, and the gasifying agent and the water vapor are fed into the top nozzle 4 and the side nozzles 5 through the gasification agent and water vapor line 28, the materials are then injected into a gasification furnace 6, the combustion and gasification process is performed at a temperature range of 1,300-2,000° C., so as to produce a crude syngas and slag with a temperature range of 1,300-2,000° C.;

wherein, the coal water slurry or coal powder, gasification agent and water vapor collide, ignite and turbulently mix at the combustion chamber center of the gasification furnace 6, forming a rotational strike and high temperature reaction zone; the residence time of a residual ash generated by the combustion and gasification in the rotational strike and high temperature reaction zone is 10 s or more (the conventional residence time in the prior technology is about 0.25 s, and the residence time in the invention is extended by 10 times or more), it reinforces the heat mass transfer and mixing process, and enhances the reaction intensity of combustion and gasification so as to obtain a gasification slag used as the cement clinker, it further improves the ignition stability, and increases the carbon conversion rate; the process is applicable to a wide range of coal types, and the throughput may be adjusted in a large extent; at the same time, the residual ash is thrown toward the furnace wall of the gasification furnace 6 and swirled downward, and solidified on the furnace wall of the gasification furnace 6 to form a slag layer; wherein the housing 1 of the gasification furnace is sequentially provided with an insulation material layer 10, a cooling sleeve 2 and a refractory layer 3 from the outside to the inside, the refractory layer 3 forms a furnace wall of the gasification furnace 6, the cooling sleeve 2 allows the refractory layer 3 to form a water-cooling wall, the residual ash hangs on a surface of the refractory layer 3, it is condensed to form a slag layer, which can improve the corrosion resistance property of the gasification furnace 6 against the residual ash, and prolong the service life of the gasification furnace 6, wherein the top nozzle 4 is arranged such that the flame direction is downward, the flame with a temperature up to about 2,000° C. will not impact the refractory material on the top of the gasification furnace 6; in addition, the top nozzle 4 has the functions of ignition and reaction, thereby eliminating the safety hazard of start knocking caused by the use of a single top nozzle of the gasification furnace, removing the defect of reducing the service life of the protective layer of the gasification furnace chamber, and eliminating the danger and frequency of replacing the ignition nozzle and reaction nozzle at a high temperature;

the resulting crude syngas and slag may form a parallel flow and rotate at a high speed, pass through a central opening of the perforated segmented conical head 11 disposed at the bottom of the gasification furnace 6, and flow into a chilling chamber 12 from the gasification product exhaust port 9 disposed underneath the central opening;

in the chilling chamber 12, the swirling cooling sleeve 13 disposed around the gasification product exhaust port 9 cools the crude syngas and the slag, and the water mist ejected from the chilled water jet head 14 at the upper portion of the chilling chamber 12 at a high speed forms a swirling flow, which perform a water chilling on the crude syngas and the slag, the slag is cooled and solidified into solid slag, and the water chilling process reaches a temperature of 500-950° C. Among them, the slag chilling and curing effect is much superior to the gas chilling. Since water has a large heat of phase transition, the used amount is relatively small, the energy consumption of water cooling is much lower than that of the cyclic chilling of the cold synthesis gas, and it imposes a small load on the subsequent waste heat boiler. At the same time, the solid slag is centrifugally rotated by the swirling flow to the chamber wall of the chilling chamber 12, and converges into the perforated conical head at the bottom of the chilling chamber 12, and then flows into the fluidized bed heat extractor 18 through the solid tremie pipe 17.

In the fluidized bed heat extractor 18, the solid slag is cooled to a temperature of 120-500° C. and become a gasification slag under the action of the atomized water mist provided by the fluidized steam and the cooled water atomization heat extraction nozzle 30 or heat extraction sleeve 25, and then the gasification slag is discharged into a moving bed heat exchanger 21 via a slag exhaust port 20, and is further cooled to a temperature less than 80° C., an intermittent dry method slagging is performed through a first-level lock bucket 22 and a second-level lock bucket 23, thereby obtain the product which can be used as the cement clinker. The dry method slagging can eliminate the problem of salinity-containing wastewater generated by the chilling of the entrained flow bed and the gasification furnace in the prior art. In addition, the slag discharge pipe does not need a use of the chilling ring, which can avoid the ubiquitous problem that the chilling ring may be easily damaged in the water chilling process of the current gas-slag parallel flow downward entrained flow furnace, which affects the long-cycle operation.

The fine ash having a high content of residual carbon may be generated during a process that the slag is cooled and solidified into the solid slag and further reduce its temperature to form the gasification slag, the fine ash exists inside the chilling chamber 12 and the fluidized bed heat extractor 18, and affects the quality of the produced gasification slag. However, the fluidized steam in the fluidized bed heat extractor 18 may carry the fine ash having a high content of residual carbon to flow upward and pass through the perforated conical head, fluidize and sort the fine ash in the slag, and the fluidized steam containing fine ash may mix with the crud syngas. In the meanwhile, the crude syngas subjects to a water chilling process in the chilling chamber 12 and it is cooled to a temperature of 500-950° C., and carries the fine ash and discharges from the chilling chamber 12 via the crude syngas outlet 15, so as to perform the ash-slag separation of the gasification slag and the fine ash. The above-mentioned heat exchange process in the chilling chamber 12 and the fluidized bed heat extractor 18 can make full use of the waste heat of the crude syngas and the slag, and the ash-slag separation performed at the same time can eliminate the problem in the prior art that the black water and salinity-containing wastewater generated are extremely difficult to be treated, and removes the common problems in the prior art concerning the blocking of the subsequent processing pipeline, the secondary pollution, and that the chilling ring in the drop tube can be easily damaged.

In addition, the treatment process of the gasification product (crude syngas and slag) in the above method changes from the primary water chilling process in the prior art to a process consisting of atomized water chilling, heat extraction in a fluidized and heat exchange in a moving bed, the operating conditions and the requirement severity on equipment are greatly alleviated.

A large amount of phase transition heat is released during the aforementioned slag cooling and solidification process. Although the crude syngas containing fine ash discharged from the crude syngas outlet 15 has been cooled, it still contains a large amount of thermal energy. When the temperature of the crude syngas discharged outside is convenient for setting up the waste heat boiler and simultaneously recovering and utilizing the heat contained in the ash, slag and syngas with the aforementioned coal gasification process, the recovery rate of waste heat is greatly improved. The crude synthesis gas containing fine ash initially flows into the gas-ash separator 16 for performing separation, the separated and purified syngas may enter into the convective waste pot to exchange heat and recover thermal energy. The separated fine ash having a high content of residual carbon is discharged into a moving bed heat exchanger 21', and cooled to a temperature less than 100° C., and then passes through an ash exhaust port 29 and subject to an intermittent dry method discharge by the first-level lock bucket 22' and the second-level lock bucket 23', and is returned to a coal powder silo 26 for cyclic utilization, thereby significantly increase the conversion rate of carbon.

Example 1

The co-production of cement clinker from coal gasification is carried out in a gasification apparatus as shown in the accompanying drawing.

The apparatus comprises a Y-type entrained flow bed, a coal powder silo 26, a syngas purification device and a slagging device; wherein the gasification furnace 6 has a height/diameter ratio of 4:1, and the included angle between the axial direction of the side nozzle 5 and the axial direction of the gasification furnace 6 is 75° (the side nozzle 5 extends upward from the side wall of the gasification furnace 6); the central axis of the side nozzle 5 is not coplanar with the central axis of the gasification furnace 6, and the central axis of the side nozzle 5 has a leftward deviation angle 50° relative to a section passing through a crosspoint between a center axis of the side nozzle 5 and a circumference of the gasification furnace 6. The distance between a spout of the side nozzle 5 and the top of the gasification furnace 6 is 2,000 mm. The number of side nozzles 5 is 3, and the side nozzles are arranged equidistant along the circumference of the gasification furnace 6.

The chilling chamber 12 has a height/diameter ratio of 4:1, and the distance between the crude syngas outlet 15 and the top of the chilling chamber 12 is 1,000 mm. The perforated conical head has an opening ratio of 25%.

The coal and lime powder are mixed to obtain coal powder, wherein the weight ratio of calcium to aluminum is 4:1, the weight ratio of calcium to silicon is 1:1, and the weight ratio of calcium to iron is 2:1. The coal powder is mixed with water to obtain coal water slurry with a solid content of 55% by weight; the gasifying agent is oxygen. The coal water slurry and oxygen are formulated according to a weight ratio of 1,000:250, and the materials ejected from the top nozzle and the side nozzles are distributed according to a weight ratio of 3:1, the coal water slurry, oxygen and water vapor are introduced into the gasification furnace of the apparatus, the combustion and gasification is performed at a temperature of 2,000° C., so as to produce a crude syngas and slag with a temperature of 2,000° C.; the residual ash and slag produced by combustion and gasification has a residence time of 150 s in the rotational strike and high temperature reaction zone of the gasification furnace;

the obtained gasification slag has a temperature of 500° C., it is cooled to a temperature less than 80° C. and subjects to a dry method slagging, and can be used as the cement clinker;

the obtained crude syngas has a temperature of 800° C., and subjects to the gas-ash separation, the obtained fine ash at a temperature of 450° C. is returned and mixed into the coal.

The experimental results reveal that there is no discharge of black water and salinity-containing wastewater. The carbon gasification rate of coal is as high as 99.5%, the comprehensive heat recovery rate is 89%, and the gasification slag applied as the cementing agent has a strength that reaches the requirement of high-grade cement with an index 625 in accordance with the national standard GB12958-1999 ("Composite Portland Cement") of the PRC., the investment amount is reduced by 40%, the throughput has an adjustment range of 150%, the coolant dosage is reduced by 80%, the load of the waste heat boiler load is reduced by 35%, there is no requirement for the volatiles of the coal, the slagging on water cooled wall is easy and uniform, and the gasification ash is recycled.

Example 2

The co-production of cement clinker from coal gasification is carried out in a gasification apparatus as shown in the accompanying drawing.

The apparatus comprises a Y-type entrained flow bed, a coal powder silo 26, a syngas purification device and a slagging device; wherein the gasification furnace 6 has a height/diameter ratio of 2:1, and the included angle between the axial direction of the side nozzle 5 and the axial direction of the gasification furnace 6 is 75° (the side nozzle 5 extends downward from the side wall of the gasification furnace 6); the central axis of the side nozzle 5 is not coplanar with the central axis of the gasification furnace 6, and the central axis of the side nozzle 5 has a rightward deviation angle 75° relative to a section passing through a crosspoint between a center axis of the side nozzle 5 and a circumference of the gasification furnace 6. The distance between a spout of the side nozzle 5 and the top of the gasification furnace 6 is 2,500 mm. The number of side nozzles 5 is 4, and the side nozzles are arranged equidistant along the circumference of the gasification furnace 6.

The chilling chamber 12 has a height/diameter ratio of 8:1, and the distance between the crude syngas outlet 15 and the top of the chilling chamber 12 is 100 mm. The perforated conical head has an opening ratio of 3%.

The coal and lime powder are mixed to obtain coal powder, wherein the weight ratio of calcium to aluminum is 2:1, the weight ratio of calcium to silicon is 3:1, and the weight ratio of calcium to iron is 3:1. The gasifying agent is oxygen. The coal powder, oxygen and water vapor are formulated according to a weight ratio of 1,000:270:125, and the materials ejected from the top nozzle and the side nozzles are distributed according to a weight ratio of 4:1; the coal powder, oxygen and water vapor are introduced into the gasification furnace of the apparatus, the combustion and gasification is performed at a temperature of 1,300° C., so as to produce a crude syngas and slag with a temperature of 1,300° C.; the residual ash and slag produced by combustion and gasification has a residence time of 100 s in the rotational strike and high temperature reaction zone of the gasification furnace;

the obtained gasification slag has a temperature of 450° C., it is cooled to a temperature of 70° C. and subjects to a dry method slagging, and can be used as the cement clinker;

the obtained crude syngas has a temperature of 950° C., and subjects to the gas-ash separation, the obtained fine ash at a temperature of 400° C. is returned and mixed into the coal.

The experimental results reveal that there is no discharge of black water and salinity-containing wastewater. The carbon gasification rate of coal reaches up to 99.3%, the comprehensive heat recovery rate is 85%, and the gasification slag applied as the cementing agent has a strength that reaches the requirement of high-grade cement with an index 625 in accordance with the national standard of the PRC, the investment amount is reduced by 35%, the throughput has an adjustment range of 60%, the coolant dosage is reduced by 78%, the load of the waste heat boiler load is reduced by 39%, there is no requirement for the volatiles of the coal, the slagging on water cooled wall is easy and uniform, and the gasification ash is recycled.

Example 3

The co-production of cement clinker from coal gasification is carried out in a gasification apparatus as shown in the accompanying drawing.

The apparatus comprises a Y-type entrained flow bed, a coal powder silo 26, a syngas purification device and a slagging device; wherein the gasification furnace 6 has a height/diameter ratio of 5:1, and the included angle between the axial direction of the side nozzle 5 and the axial direction of the gasification furnace 6 is 85° (the side nozzle 5 extends upward from the side wall of the gasification furnace 6); the central axis of the side nozzle 5 is not coplanar with the central axis of the gasification furnace 6, and the central axis of the side nozzle 5 has a leftward deviation angle 5° relative to a section passing through a crosspoint between a center axis of the side nozzle 5 and a circumference of the gasification furnace 6. The distance between a spout of the side nozzle 5 and the top of the gasification furnace 6 is 500 mm. The number of side nozzles 5 is 6, and the side nozzles are arranged equidistant along the circumference of the gasification furnace 6.

The chilling chamber 12 has a height/diameter ratio of 2:1, and the distance between the crude syngas outlet 15 and the top of the chilling chamber 12 is 500 mm. The perforated conical head has an opening ratio of 20%.

The coal and lime powder are mixed to obtain coal powder, wherein the weight ratio of calcium to aluminum is 3:1, the weight ratio of calcium to silicon is 4:1, and the weight ratio of calcium to iron is 1:1. The coal powder is mixed with water to obtain coal water slurry with a solid content of 75% by weight; the gasifying agent is air. The coal water slurry and oxygen are formulated according to a weight ratio of 1,000:360, and the materials ejected from the top nozzle and the side nozzles are distributed according to a weight ratio of 1:1, the coal water slurry, air and water vapor are introduced into the gasification furnace of the apparatus, the combustion and gasification is performed at a temperature of 1,600° C., so as to produce a crude syngas and slag with a temperature of 1,600° C.; the residual ash and slag produced by combustion and gasification has a residence time of 180 s in the rotational strike and high temperature reaction zone of the gasification furnace;

the obtained gasification slag has a temperature of 700° C., it is cooled to a temperature less than 80° C. and subjects to a dry method slagging, and can be used as the cement clinker;

the obtained crude syngas has a temperature of 700° C., and subjects to the gas-ash separation, the obtained fine ash at a temperature of 490° C. is returned and mixed into the coal.

The experimental results reveal that there is no discharge of black water and salinity-containing wastewater. The carbon gasification rate of coal is as high as 99.0%, the comprehensive heat recovery rate is 85%, and the gasification slag applied as the cementing agent has a strength that reaches the requirement of high-grade cement with an index 625 in accordance with the national standard of the PRC, the investment amount is reduced by 30%, the throughput has an adjustment range of 100%, the coolant dosage is reduced by 81%, the load of the waste heat boiler load is reduced by 30%, there is no requirement for the volatiles of the coal, the slagging on water cooled wall is easy and uniform, and the gasification ash is recycled.

The above examples are the results of the pilot scale test (the pilot scale is 3,600 kg/d), and there is no discharge of black water and salinity-containing wastewater. The carbon gasification rate of coal is 99% or more, the comprehensive heat recovery rate is more than 85%, and the gasification slag applied as the cementing agent has a strength that reaches the requirement of high-grade cement with an index 625 in accordance with the national standard of the PRC, the investment amount is reduced by 30%, the throughput has an adjustment range of 60%-150%, the coolant dosage is reduced by 80%, the load of the waste heat boiler load is reduced by 30%, there is no requirement for the volatiles of the coal, the slagging on water cooled wall is easy and uniform, and the gasification ash is recycled, thus can meet the requirements of the industrial department for the efficient and large-scale synthetic gasification furnace.

The above content describes in detail the preferred embodiments of the present invention, but the invention is not limited thereto. A variety of simple modifications can be made to the technical solutions of the invention within the scope of the technical concept of the invention, including a combination of individual technical features in any other suitable manner, such simple modifications and combinations thereof shall also be regarded as the content disclosed by the present invention, each of them falls into the protection scope of the present invention.

What is claimed is:

1. A gasification co-generation process of coal powder in a Y-type entrained flow bed, comprising the following steps:

(1) mixing coal with lime powder to obtain coal powder, or mixing the coal, lime powder and water to obtain coal water slurry; in the coal water slurry or coal powder, the weight ratio of calcium to aluminum is 2-4:1, the weight ratio of calcium to silicon is 1-4:1, and the weight ratio of calcium to iron is 1-3:1;

(2) introducing the coal water slurry or coal powder, gasification agent and water vapor into a gasification furnace of a Y-type entrained flow bed, and performing combustion and gasification at a temperature range of 1,300-2,000° C., so as to produce a crude syngas and slag at a temperature range of 1300-2000° C., the gasification furnace comprising a furnace wall;

wherein the coal water slurry or coal powder, gasification agent and water vapor are sprayed into the gasification furnace through a top nozzle and a plurality of side nozzles of the gasification furnace, and collide, ignite and turbulently mix with each other at a combustion chamber center of the gasification furnace, to form a rotational strike and high temperature reaction zone; the residence time of a residual ash generated by the combustion and gasification in the rotational strike and high temperature reaction zone is 10 s or more;

the residual ash is thrown toward the furnace wall of the gasification furnace and swirled downward, and solidified on the furnace wall of the gasification furnace to form a slag layer;

(3) introducing the crude syngas and slag into a chilling chamber to carry out chilling with water, wherein the slag is cooled and solidified into a solid slag with a temperature of 500-950° C.; the solid slag passes through a solid discharge pipe with a perforated segmented conical head and flows into a fluidized bed heat extractor, and then its temperature is reduced to 120-500° C. under the action of a fluidized vapor and an atomized water mist or a heat extraction sleeve to obtain gasification slag, in the meanwhile, the fluidized vapor carries a fine ash having a high content of residual carbon and flows upward to pass through a perforated conical head, so as to further fluidize and sort the fine ash in the solid slag, then obtained fluidized vapor containing fine ash mixes with the crude syngas; the gasification slag is discharged from the fluid bed heat extractor, and is further cooled to a temperature less than 80° C. and subjects to a dry method slagging to produce a cement clinker;

the crude syngas is cooled by the chilling with water to a temperature range of 500-950° C., and carries the fine ash and is discharged from the chilling chamber to separate the fine ash from the gasification slag;

(4) discharging the crude syngas carrying fine ash from the chilling chamber, and further performing a gas-solid separation by means of a gas-ash separator to obtain a separated and purified syngas, the separated and purified syngas enter into a convective waste pot for heat recovery and is then ready for use; a separated fine ash passes through an ash exhaust port and is discharged into a moving bed heat exchanger, and is cooled to a temperature less than 500° C. and discharged and then returned to step (1) and mixed into the coal.

2. The process according to claim 1, wherein the weight ratio of raw materials ejected from the top nozzle and raw materials ejected from the side nozzles is 1-4:1.

3. The process according to claim 1, wherein the weight ratio of the coal powder, the gasification agent and the water vapor is 1,000:(120-360):(100-200), or the weight ratio of the coal water slurry and the gasification agent is 1,000:(120-360).

4. The process according to claim 1, wherein the gasification furnace and the chilling chamber are separated by the perforated segmented conical head, and the fluidized bed heat extractor is underneath the chilling chamber; wherein the gasification furnace comprises a top center provided with a top nozzle, and the upper portion of the gasification furnace is provided with three or more side nozzles which are disposed radially inclined along the circumferential direction;

the segmented conical head is disposed at the bottom of the gasification furnace, the segmented conical head has a central opening and a gasification product exhaust port underneath the opening, wherein the gasification product exhaust port is communicated with the chilling chamber;

the upper portion of the chilling chamber is provided with a crude syngas outlet connected to the gas-ash separator;

a plurality of independent cooled water atomization heat extraction nozzles and a heat extraction sleeve are disposed on an upper portion of the fluidized bed heat extractor, and a slag exhaust port is disposed at a bottom of the fluidized bed heat extractor.

5. The process according to claim 4, wherein the radially inclined side nozzle has an arrangement condition comprising: an included angle between an axial direction of the side nozzles and an axial direction of the gasification furnace is within a range of 75°-90°; the side nozzles having a central axis that is not coplanar with the central axis of the gasification furnace; the central axis of the side nozzles is offset from a cross section passing through an intersection point between the central axis of the side nozzles and the circumference of said gasification furnace by an angle ranging from 5°-75°.

6. The process according to claim 4, wherein the gasification furnace has a height/diameter ratio of 2-5:1; the distance between the spout of the side nozzle and the top of said gasification furnace is within a range of 500-2,500 mm.

7. The process according to claim 4, wherein gasification furnace comprises a housing and the housing is provided with an insulation material layer, a cooling sleeve and a refractory layer sequentially from the outside to the inside;

a coolant inlet communicating with the cooling sleeve is disposed at the bottom of the gasification furnace, and a coolant outlet communicating with the cooling sleeve is disposed at the top of the gasification furnace;

the refractory layer of the gasification furnace is formed by casting a silicon carbide or magnesium aluminum spinel material.

8. The process according to claim 4, wherein the chilling chamber has a height/diameter ratio of 2-8:1;

the chilling chamber is formed by casting a heat-insulating and wear-resistant material;

the distance between the crude syngas outlet in the chilling chamber and the top of the chilling chamber is within a range of 100-1,000 mm;

the perforated conical head has an opening ratio of 3%-25%.

9. The process according to claim 4, wherein the lower portion of the fluidized bed heat extractor is provided with a distributor for water vapor or an inert gas; the distance between the solid discharge pipe and the distributor is within a range of 100-500 mm;

in the heat extraction sleeve, an inlet pipe is connected to an inlet pipe of the heat extraction sleeve through an inlet valve, and the outlet pipe is communicated with a steam pocket through an outlet valve.

10. The process according to claim 4, wherein a moving bed heat exchanger and a two-level lock bucket material discharger are sequentially provided at an outlet of the fluidized bed heat extractor and an outlet of the gas-ash separator, respectively.

* * * * *